US008627702B2

(12) United States Patent
d'Hone

(10) Patent No.: US 8,627,702 B2
(45) Date of Patent: Jan. 14, 2014

(54) METHOD FOR ROLLING METAL STRIPS, PARTICULARLY STEEL STRIPS

(75) Inventor: André d'Hone, Krefeld (DE)

(73) Assignee: Outokumu Nirosta GmbH, Krefeld (DE)

( * ) Notice: Subject to any disclaimer, the term of this patent is extended or adjusted under 35 U.S.C. 154(b) by 731 days.

(21) Appl. No.: 12/447,619

(22) PCT Filed: Oct. 26, 2007

(86) PCT No.: PCT/EP2007/061533

§ 371 (c)(1),
(2), (4) Date: Jul. 30, 2009

(87) PCT Pub. No.: WO2008/052939

PCT Pub. Date: May 8, 2008

(65) Prior Publication Data

US 2010/0064754 A1 Mar. 18, 2010

(30) Foreign Application Priority Data

Oct. 30, 2006 (DE) ..... 10 2006 051 728

(51) Int. Cl.
*B21B 31/18* (2006.01)

(52) U.S. Cl.
USPC ..... 72/347; 72/243; 72/252.5; 72/241.8; 72/366

(58) Field of Classification Search
USPC ..... 72/7.1, 7.2, 7.3, 7.4, 7.5, 7.6, 7.7, 7.8, 72/247, 365.2, 243, 366; 29/122
See application file for complete search history.

(56) References Cited

U.S. PATENT DOCUMENTS 3,857,268 A * 12/1974 Kajiwaka ..... 72/247
4,440,012 A * 4/1984 Feldmann et al. ..... 72/201

(Continued)

FOREIGN PATENT DOCUMENTS

DE 30 38 865 C1 12/1982
DE 197 18 529 A1 11/1998
EP 0 276 743 B1 8/1988
EP 0 672 471 B1 9/1995

(Continued)

OTHER PUBLICATIONS

T. Nakanishi "Application of Work Roll Shift Mill "HCW-MILL" to Hot Strip and Plate Rolling", Hitachi Review vol. 34 (1985), No. 4 pp. 153-160.

(Continued)

*Primary Examiner* — Dana Ross
*Assistant Examiner* — Homer Boyer
(74) *Attorney, Agent, or Firm* — The Webb Law Firm

(57) ABSTRACT

A method of rolling metal strip, and in particular steel strip, in which the metal strip passes through the roll gap of at least one roll stand, allows the work rolls of the roll stand which define the roll gap to be able to be shifted along their axes of rotation if differences occur in the shape of the roll gap from its desired shape. The method provides for flat products to be rolled which meet very stringent requirements in respect of their dimensional accuracy. For this purpose, the work rolls are shifted in the same direction in accordance with the invention, following a given shift strategy which is characterized by a regular change in the direction of shift (R−, R+) as a function of the reaching of given maximum shifted positions (V2, V4, V6, . . . , V28, V28, V30, V32 . . . , V53).

8 Claims, 4 Drawing Sheets

(56) References Cited

U.S. PATENT DOCUMENTS

| | | | | | |
|---|---|---|---|---|---|
| 4,656,859 | A | * | 4/1987 | Ginzburg | 72/243.6 |
| 4,864,836 | A | * | 9/1989 | Ochiai | 72/11.7 |
| 4,881,396 | A | | 11/1989 | Seidel et al. | 72/247 |
| 4,934,166 | A | * | 6/1990 | Giacomoni | 72/247 |
| 5,448,901 | A | * | 9/1995 | Yu et al. | 72/7.2 |
| 5,592,846 | A | * | 1/1997 | Watanabe et al. | 72/206 |
| 5,970,771 | A | * | 10/1999 | Ginzburg | 72/247 |
| 6,164,103 | A | * | 12/2000 | Pichler et al. | 72/7.1 |
| 8,096,161 | B2 | * | 1/2012 | Baumgartel et al. | 72/247 |
| 2005/0034501 | A1 | | 2/2005 | Seilinger et al. | 72/252.5 |
| 2007/0199363 | A1 | | 8/2007 | Baumgartel | 72/241.8 |

FOREIGN PATENT DOCUMENTS

| | | |
|---|---|---|
| JP | 62282710 | 12/1987 |
| JP | 6015322 | 1/1994 |
| WO | 03/022470 | 3/2003 |

OTHER PUBLICATIONS

K. Eckelsbach et al. "Schedule-Free Rolling Strategies Based on Contour Control for Flexible Hot Strip Mill Concepts", International Symposium on Steel Industry Development and Management Proceedings (1997), Shanghai, pp. 163-171.

International Search Report for International Application No. PCT/EP2007/061533, Dec. 2007.

* cited by examiner

METHOD FOR ROLLING METAL STRIPS, PARTICULARLY STEEL STRIPS

CROSS-REFERENCE TO RELATED APPLICATIONS

This application is a National Phase Application of International Application No. PCT/EP2007/061533, filed on Oct. 26, 2007, which claims the benefit of and priority to German patent application no. DE 10 2006 051 728.8-55, filed on Oct. 30, 2006. The disclosures of the above applications are incorporated herein by reference in their entirety.

FIELD OF THE INVENTION

The invention relates to a method of rolling metal strip, in particular steel strip, in which the metal strip passes through the roll gap of at least one roll stand, the work rolls of the roll stand which define the roll gap being shifted along their axes of rotation if differences occur in the shape of the roll gap from a desired shape.

BACKGROUND

As explained in, for example, T. Nakanishi et al., "Application of Work Roll Shift Mill—HCW Mill—to Hot Strip Plate Rolling", Hitachi Review, Vol. 34 (1985), No. 4 and K. Eckelsbach, G. Kneppe, D. Rosenthal, H. Wolters "Schedule-Free Rolling Strategies Based on Contour Control for Flexible Hot Strip Mill Concepts", SMS-Schloemann-Siemag AG, Düsseldorf and Hilchenbach/Germany, ISIDIM '97 Conference Proceedings, pages 163-171, wear on the work rolls has a significant effect on the contour of the roll gap. The roll-gap contour is also affected by the crowning of the work rolls, the so-called "thermal crowning", which is a consequence of the heating-up which goes hand in hand with the operation of rolling. Both the wear on the rolls and the thermal crowning may become so severe that the roll-gap contour, and hence too the metal strip which passes through the roll gap, are subject to differences from the desired shape which go beyond a size allowable as a tolerance.

To ensure that there is a proper roll-gap contour in spite of the differences in the shape of the work rolls which result from the wear on the rolls and the formation of the crowning, it is proposed in, for example, EP 0 276 743 B1 that the work rolls be shifted cyclically in opposite directions along their axes of rotation. Work rolls which were ground to an ideal cylindrical or crowned shape were used in this case.

As a result of this practical step, the wear on the rolls and the thermal crowning can be regularized to an appreciable degree, thus enabling the risk of so-called high spots or humps on the flat product being rolled to be appreciably reduced. In practice however this is not a successful way of completely avoiding the unwanted differences in shape in question.

It is also known, from DE 10 2004 031 354 A1, for intermediate or supporting rolls, which are provided in the manner described in for example DE 30 38 865 C1 with a so-called CVC grind and against which the work rolls of the given roll stand are supported, to be shifted axially in such a way that the roll-gap contour has in each case a parabolic component (a $2^{nd}$ order component). At the ratios of work-roll length to work-roll diameter which exist in hot rolling mills, this component corresponds to the component represented by the bending of the work rolls. By means of variations in the bending force, a cyclic shift of the CVC rolls in opposite directions can then be performed to compensate for wear without this causing any change in the roll-gap contour. However, because, unlike direct shifting of the work rolls themselves, the shifting of the intermediate or supporting rolls calls for an appreciably larger range of adjustment if it is to affect the roll-gap contour, limits are set to this procedure in practice. In this way, steep transitions form between the region of the work roll which has been worn and its unworn region which result in what are termed tight edges on the rolled stock after a comparatively short time in operation. "Tight edges" of this kind produce edges which undulate in short cycles on the edge of the metal strip which is being rolled at the time. This may happen if the work rolls have to be shifted beyond the range of adjustment used for compensating for the wear on the work rolls. In the case of the rolls which are used in the known methods, the occurrence of this phenomenon generally makes it necessary for the rolls to be changed at an early point in time or results in marked restrictions on a schedule-free rolling program, i.e. a rolling program which is carried out without reference to the width of the strip which is to be rolled at the time.

Even if the prior art explained above assumes that the roll-gap contour can be reduced to, in essence, a parabola, i.e. a $2^{nd}$ order function, the shape of the roll gap may however be composed in practice of, in addition, $4^{th}$ order components and large components of even higher orders. This is particularly true when the roll pressures are high, such as they need to be when very small target thicknesses are being produced in the rolled stock. The $4^{th}$ and higher order components affect the roll gap particularly when rolled stock has to be rolled whose width is large compared with the width of the roll gap, thus producing a ratio of the width of the work rolls to the width of the rolled stock which is adversely large. Precisely when rolled stock of large widths is being rolled, these conditions may result in considerable flaws in flatness because almost no flow of material transverse to the direction of rolling can take place in thin metal strip.

To minimize the effect of higher order components of shape, there have been proposed in EP 0 294 544 B1 and WO 03/022470 grinds for rolls which likewise affect components of the fourth and higher orders by axial shifting in opposite directions.

Also known, from EP 0 672 471 B1, are what are referred to as "anti-hump rolls" by whose axial shifting in opposite directions components of shape of higher orders can be acted on principally in the edge region of the roll-gap contour. If rolls of this kind were shifted cyclically relative to one another to correct for wear and thermal crowning, what would be produced as a consequence would be components of the fourth or higher orders which could not be compensated for by bending. There is also the risk of tight edges if the rolls are shifted after a long period of rolling. When rolls of this type are used, an even more severe limitation of the rolling schedule is therefore required.

Despite the large number of attempts which have been made to compensate for or eliminate the adverse effects of the change in the shape of the rolls of a roll stand as a result of wear and heating-up, it is only with difficulty that components of shape of the fourth or higher orders can be corrected for in practice at the roll-gap contour. This is particularly true on hot rolling lines, where the width of the material to be rolled is in each case wide in comparison with the width of the rolls. The outcome of this is that, even when use is made of specially ground rolls and of a cyclic shift of the rolls in opposite directions, it still has to be accepted that there will be non-flatness on the rolled stock obtained.

SUMMARY OF THE INVENTION

Against the background of the prior art explained above, an aspect of the invention is to specify a method by which it would be possible to roll flat products which met very stringent requirements in respect of their dimensional accuracy. The intention is in particular that this method should ensure improved figures for flatness in the hot rolling of steel strip and specifically cast strip.

The aspect indicated above is achieved in accordance with the invention by virtue of a method, in which the metal strip passes through a roll gap of at least one roll stand, the work rolls of the roll stand which define the roll gap being able to be shifted along their axes of rotation if differences occur in the shape of the roll gap from a desired shape. The method includes (a) shifting each of the work rolls in the same direction; (b) starting from a starting position, maintaining a given direction of shift until a respective maximum shifted position is reached at which a first change takes place in the direction of shift; (c) maintaining the direction of shift which has commenced in a given case until a maximum shifted position is reached which, relative to the starting position is larger in size than, or equal in size to, the maximum shifted position which was reached previously in the opposite direction of shift; (d) on the given maximum shifted position being reached, reversing the direction of shift; (e) repeating steps (c) and (d) until the size of the give maximum shifted position has reached a maximum value; (f) starting from the maximum shifted position corresponding to the maximum value, maintaining the given direction of shift until a respective maximum shifted position is reached which, relative to the starting position, is smaller in size than, or equal in size to, the maximum shifted position which was reached previously in the opposite direction of shift; (g) on the given maximum shifted position being reached, reversing the direction of shift; (h) repeating steps (f) and (g) until the given maximum shifted position of the work rolls corresponds to a minimum value; (i) repeating a sequence of steps of (b) to (h) if a worn state of the work rolls is within a permitted range, or the work rolls are replaced if at least one of the work rolls has reached a state which is outside the permitted range.

In general, the invention makes available a possible way in which a cyclic shift can be performed for the purpose of homogenizing wear and the effect of thermal crowning on the result of the rolling process, it being possible in this case for, in particular, the effect of components of shape of the fourth or higher orders to be minimized to equal extents. At the same time, the procedure according to the invention enables use to be made of larger travels in shift and hence the usable time in operation of the rolls to be lengthened and the roll-gap contour to be optimized easily by matching the manner in which the shift is performed to the particular form of the wear profile of the rolls.

For this purpose, the invention first makes provision for the work rolls of a roll stand not to be shifted in different, opposite, respective directions but in the same direction, i.e. each in one and the same direction. At the same time, the invention makes available a shift strategy which enables use to be made of rolls for an optimum length of time.

As soon as it is indicated that this should be done as a result of the wear on the rolls, the work rolls of a roll stand are thus shifted, in accordance with the invention, in the same direction, in parallel with one another. It is not only an optimized flatness that this shift in parallel performed in accordance with the invention produces due to the fact that the contour of the roll gap itself is not changed by the shift. Surprising, it has also been found in this connection that despite the shift of both rolls in, in each case, only one direction the strip maintains its direction of movement and its path of movement, i.e. the movement of the strip is not interfered with by the displacement of the rolls which, in accordance with the invention, in each case takes place together in one direction.

This being the case, it is possible, as a result of the extremely long travels in shift which are made possible in accordance with the invention and of the high speed of shift which is equally possible without any problems, for the shift strategy to be selected in such a way that the roll gap takes a parabolic form following a second order function. This difference in shape can, in turn, be easily eliminated by subjecting the particular rolls, individually or together, to a bending load.

By the use of fifth order roll grinds, or in other words what are referred to as "CVC Plus" rolls, or approximately fifth order grinds or what are referred to as "Smart Crown" rolls, which grinds can be combined with components of shape of the third or even higher odd orders, the range of adjustment over which the contour of the roll gap can be acted on can be considerable enlarged in the mode of operation according to the invention. This also applies to appropriately modified anti-hump rolls and to so-called "tapered" or "CVC tapered" rolls.

So that there will not be any changes in the roll-gap contour when the work rolls are shifted axially in the same direction, a constant roll-gap contour has to be maintained across the width. Hence, it is essential in this particular embodiment for the rolls to be of symmetrical shapes and in particular of shapes of mirror-image symmetry. Hence it must be ensured that in a given shifted position, the so-called "neutral position", the distance between the rolls, and hence the roll-gap contour, is constant when looked at across the width. The roll diameter may be variable across the width in this case. What this means is that a positive ground contour on the lower work roll, at a given point relative to a virtual zero point in the center of the crown, corresponds to a contour which is made negative on the upper work roll at this point. This is the case with roll grinds in accordance with DE 30 38 865 C1 (second order roll-gap contour), and EP 0 294 544 B1 and WO 03/022470 (second and fourth order roll-gap contours) and with mirror-image forms of roll grind (e.g. as in EP 0 672 471 B1, a higher order roll grind).

However, as a result of the shift of the rolls in the same direction which is applied in accordance with the invention, the principal advantage of the invention lies in the fact that, due to larger travels in shift with third order roll grinds (e.g. CVC grinds, which can be compensated by bending) and due to the shift of fifth and higher odd order roll grinds which becomes possible for the first time, the possibility exists of reliably regularizing non-flatnesses caused by wear and thermal crowning. Only in this way does it become at all possible for sensible use to be made of fifth order or approximately fifth order roll grinds in hot rolling stands. It is precisely in hot rolling stands that increased wear takes place in the region of the edges of the rolled stock and that, due to the high rolling temperatures, the rolls tend to form a thermally induced crown.

To enable fourth or higher order components of shape to be set in the roll-gap contour, the cyclic shift in parallel may be interrupted and the roll set moved to the neutral position. The roll set may then be shifted in opposite directions to allow the desired roll-gap contours to be set. Both rolls may be shifted in this case or one roll may remain stationary while the other is moved to whatever position is required in the given case.

With a procedure according to the invention and when third order roll grinds are used, there is no longer any need for second order components to be compensated for in the roll gap. Hence, with a combination of this kind, there is no longer any risk of non-flatnesses occurring as a result of inexactly calculated sensitivities to shift/bending.

By the shift in accordance with the invention of only one roll when there is a fifth order or approximately fifth order roll grind it is possible for quarter waves on one side (third order non-flatnesses) to be eliminated. For this purpose, whichever roll is the counter roll must be in its neutral position. The zero, first and second order components which occur in addition in this case can be compensated for by closing the gap and by pivoting and bending. The amounts of adjustment which have to be allowed for in this case can be calculated in a manner which is known per se.

Alternatively, what may also be used for the zero and first order components in place of the options for calculation mentioned above are monitoring regulating arrangements or arrangements for compensation by pivoting such as are described in DE 197 18 529 A1. On hot rolling stands, the effect in question may also be supported or assisted by high-speed actuators, such as for differential bending, because the geometrical conditions which exist in this case are approximately the same. As a result of the variation in bending force on one side, a third order component is likewise generated in the roll-gap contour by this means to a good approximation.

If only one roll is shifted when there is a third order roll grind, this may even take place at a point away from the neutral position. An advantageous embodiment of the invention therefore makes provision for the roll set also to be shifted in opposite directions, independently of or in addition to its being shifted in parallel in accordance with the invention, to achieve a supplementary regularization of wear and thermal crowning. A second order change in the roll-gap contour for example can be brought about in this way. In this case too, the zero and first order components should be compensated for in the appropriate way. What is more, rolls which are for example shaped in accordance with the prior art described in EP 0 294 544 B1 or in WO 03/022470 may also be individually shifted in order to eliminate asymmetrical third order non-flatnesses which are found on the rolled stock. In the event of a shift of this kind, the third order component of shape produced by the shift may also be assisted by differential bending of the work rolls. Greater or lesser bending, as appropriate, is applied on one side in this case. The additional first order component which occurs with both methods may in turn be eliminated by pivoting and the second order component may be eliminated by reducing or increasing the total bending force acting on the rolls.

A further advantage of the invention is that the non-flatnesses which would otherwise be produced by high rolling pressures or rolling forces can be completely eliminated by virtue of the possibility provided by the invention of using roll grinds of the fifth and higher odd orders (individually or in combination with one another and with third order grinds). When this is the case, the possibility of a cyclic wear-oriented shift achieved by a shift in parallel remains unchanged. The invention therefore allows particularly thin strip, and especially hot rolled strip, which is notable for outstanding dimensional accuracy, to be rolled.

The high travels in shift which are made possible in accordance with an embodiment of the invention regardless of the roll grind which is used in the given case allow the rolls of a roll stand which are adjusted in accordance with the invention to have an appreciably longer time in use than is the case with the prior art.

The method according to an embodiment of the invention is particularly suitable for application to roll stands which are arranged downstream of the casting section of a system for casting thin slabs or of a system for casting thin strip. Systems of the latter type in particular supply cast material of a constant width, and the wear parameters, and the strategy for the shift of the rolls which arises from these, can thus be exactly determined in advance.

It has to be borne in mind that, as mentioned, with the ratios of roll diameter to roll-crown width and the widths of rolled stock which exist in practice on hot rolling lines, the bending of the rolls produces second order components of contour in the roll gap. In corresponding cold rolling stands or on tandem lines on the other hand it is more likely to be fourth order components which are produced by the bending. In each of these applications, the procedure according to the invention allows the given work rolls each to be adjusted in such a way that the result obtained from the rolling is optimum.

An embodiment of the invention which is advantageous in respect of the optimization of the time in use of the work rolls and the regularization of their pattern of wear is characterized in that at least six, and in particular at least ten, changes of the direction of shift are made between the starting position and the point at which the shifted position reaches its maximum value. As a rule of thumb, it can thus be said that the more frequent are the changes of direction up to the point where the maximum value is reached the better is the result of the rolling.

However, practical and theoretical investigations have shown that the wear on the work rolls can also be minimized by performing, between two rolling operations in which the work rolls are at shifted positions of a maximum size, at least one rolling operation in which the work rolls occupy a shifted position which is located between the maximum shifted positions in question.

What may be taken as a guideline value for the initiation of a shift is the completion of the rolling of a metal strip or the movement through, during the rolling, of a given length of the metal strip being rolled. Practical experience shows that, in for example the hot rolling of a steel strip of a usual length, such high wear occurs on the work rolls that, under the operating conditions which usually apply, it is necessary at this point for the work rolls to be adjusted to enable optimum results from the rolling also to be ensured for the strips which are rolled after this. An embodiment of the invention which is particularly worthwhile for the practical operator therefore makes provision for at least one metal strip to be rolled for its entire length when the work rolls are located in one shifted position and for a shift of the work rolls to be performed on completion of the rolling of this metal strip.

However, to enable the crowning of the work rolls due to their heating-up to be corrected for even more effectively, it may also be useful, while making due allowance for the design of the given roll stand and the limits (on shifting force, rolling speed, rolling force, twisting action of roll grinds, coefficient of friction) preset by the rolling parameters which are applied in the given case, for the shift which is made of the work rolls to be a steady one which is in the same direction and as fast as possible. An obvious use for a shift of this kind under load is in continuous or semi-continuous rolling. It can be performed continuously or after given lengths of rolling, etc.

To give the greatest possible freedom in the setting of the roll-gap contour, it is beneficial for the work rolls to be pivoted and/or bent in a known manner in one or more directions in order to set a given roll-gap contour. For example, both as a result of the occurrence of thermal crowning on the work rolls and when use is made of rolls having a second order parabolic or CVC grind which are shifted in opposite directions to set a given roll-gap contour, and also in the case of roll stands having displaceable chocks, there may be a displacement of the point of reversal of the roll-gap parabola away from the center of the strip. This deviation produces, in the roll gap, a difference in shape which takes the form of a slanted position for the roll gap which can be defined by a first order polynomial. This difference in shape can be eliminated by pivoting the work rolls to open up the roll gap in the direction of the displacement. This opening up is not necessary when there is a pivoting movement about the center axis of the roll set.

BRIEF DESCRIPTION OF THE DRAWINGS

In what follows, the invention will be explained in detail by reference to drawings which show an embodiment. The drawings are schematic views and what they show is in each case of a very much exaggerated form for the sake of greater clarity. In them.

DETAILED DESCRIPTION

Figure 1:
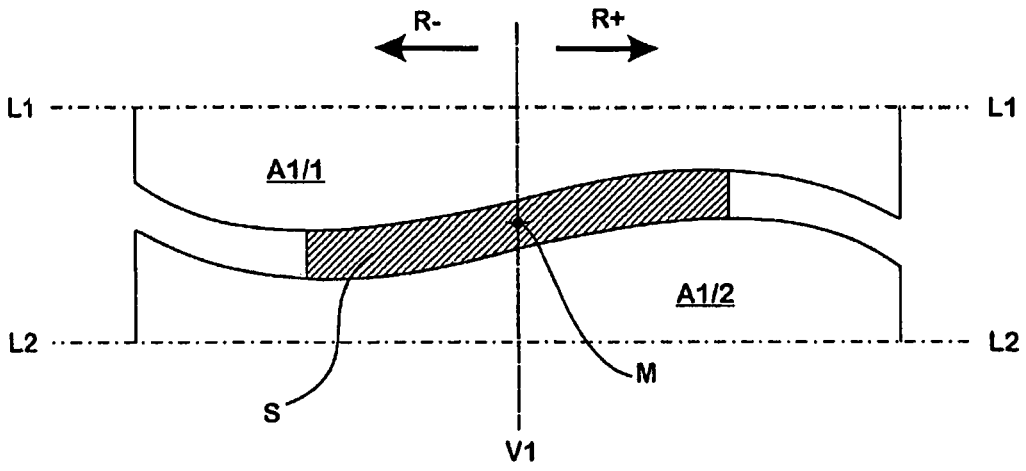
FIG. 1 shows a pair of work rolls having a third order CVC grind, in the starting position (the "0" position) at the beginning of the rolling process or when the work rolls are in the new state.
Figure 2:
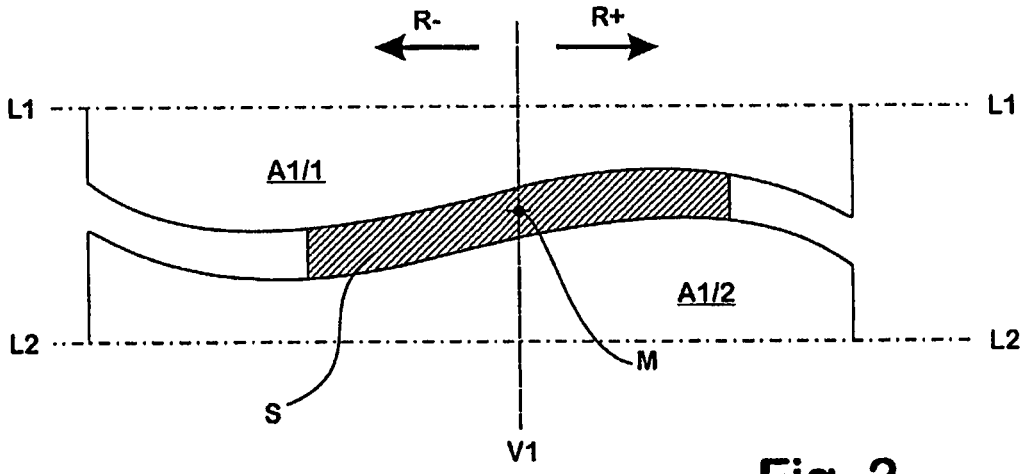
FIG. 2 shows a shift of the work rolls shown in FIG. 1 in the same direction.
Figure 3:
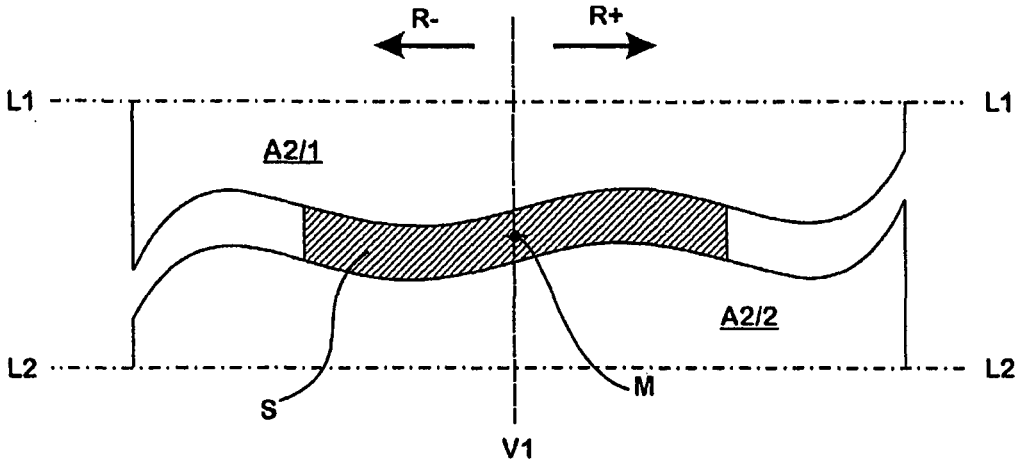
FIG. 3 shows a pair of work rolls having a fifth order CVC grind, in the starting position (the "0" position) at the beginning of the rolling process or when the work rolls are in the new state.
Figure 4:
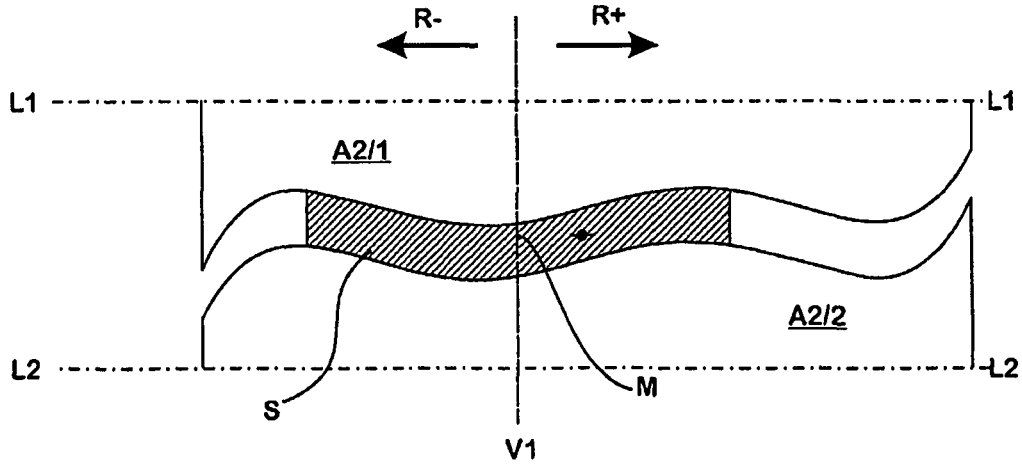
FIG. 4 shows a shift of the work rolls shown in FIG. 3 in the same direction.

At the starting positions which are shown in FIGS. 1 and 3 there is obtained in the respective cases, both for the work rolls A1/1 and A1/2 having a third order grind which are used in the new state (FIGS. 1, 2), and for the work rolls A2/1 and A2/2 having a fifth order grind (FIGS. 3, 4), a linear roll-gap contour which ensures optimized flatness for the steel strip S which is being rolled at the time.

If differences in the shape of the strip S leaving the roll gap which go beyond the range of tolerances occur or, as a precaution, before each occasion on which a new steel strip is going to be rolled, the work rolls A1/1, A1/2 or A2/1, A2/2, as the case may be, are moved together, as a pair, in the same direction in the manner according to the invention along their axes of rotation L1, L2 in a direction R− or R+. Even though the center of the pair of work rolls A1/1, A1/2 or A2/1, A 2/2 moves relative to the center axis M of the steel strip S when this is done, there is, surprisingly, no disruption (curving) of the movement of the steel strip S which would adversely affect its shape. Instead, because the shift of the pairs of work rolls A1/1, A1/2 and A2/1, A2/2 takes place in parallel, the roll gap maintains its optimum shape which was set in the starting position (FIG. 1, FIG. 3).

Figure 5:
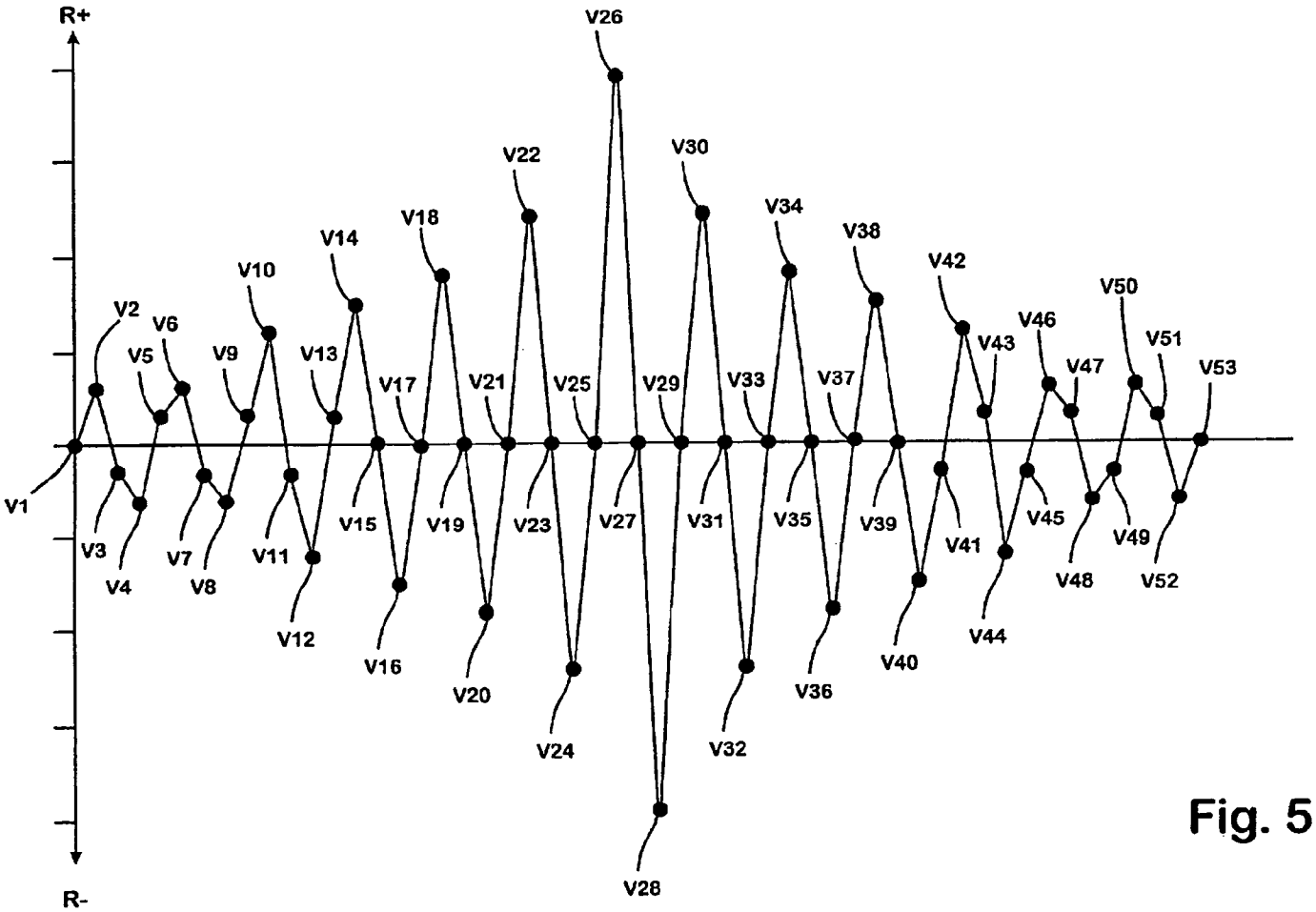
FIG. 5 shows a shift strategy according to the invention.

The shift of the pairs of work rolls in the same direction follows, in this case, the shift strategy which is shown by way of example in FIG. 5. What are shown, in the co-ordinate system represented in FIG. 5, are the shifted positions V1-V53 which were set, in the hot rolling of steel strips S1-S53 respectively which were cast by a strip casting machine of the twin-roller type, for the work rolls which were used in this case, which are not shown in this case and which may for example be shaped to correspond to the work rolls A1/1, A1/2 and A2/1, A2/2 which are shown in FIGS. 1-4. All the steel strips S1-S53 were of the same width.

In FIG. 5, the position on the abscissa (the x-axis) indicates the starting position at which the work rolls were located in the position shown in FIGS. 1 and 3 (the "0" position of the work rolls). Shown on the ordinate axis (the y axis) are the respective shifted positions V1-V53 which the work rolls occupied after respective shifts in a positive direction R+ (pointing to the right in FIGS. 1-4) or a negative direction R− (pointing to the left in FIGS. 1-4) relative to the starting position.

In the case of the shift strategy described here, the work rolls were in each case shifted, in the manner according to the invention, in parallel in the same direction on completion of the hot rolling of one of the steel strips S1-S53, because after each passage through of a steel strip the state of wear which had been reached was one which made it necessary for there to be an appropriate shift.

Accordingly, the first steel strip S1 was hot rolled with the work rolls in the starting position V1 (the "0" position). On completion of the hot rolling of steel strip S1, the work rolls were shifted in the positive direction of shift R+ until a first shifted position V2 was reached. With the work rolls in this shifted position V2, steel strip S2 was rolled in its entirety.

Basically, it would have been possible, starting from the shifted position V2, for a further shift to have been made in the direction of shift R+ (a shift towards the right). In the present case however, the shifted position V2 was considered to be a first maximum shifted position at which a first change was made in the direction of shift.

Accordingly, on completion of the hot rolling of steel strip S2, the work rolls were shifted in the direction of shift R−, which was in the negative range of shift relative to the starting position V1. The hot rolling of steel strip S3 took place with the work rolls situated in this shifted position V3.

Because the shifted position V3 which was in the negative range relative to the starting position (which was a shift to the left) was a shorter distance away from the starting position V1 than the shifted position V2 reached previously, i.e. was smaller in size than the shifted position V2, the work rolls were again shifted in the negative direction of shift R− on completion of the hot rolling of steel strip S3 until the shifted position V4 was reached. This latter position was situated at the same distance from the starting position V1 as the maximum shifted position V2 which was previously reached in the direction of shift R+.

Accordingly, after the hot rolling of steel strip S4, the work rolls, at the shifted position V4, which was now the maximum position for the direction of shift R−, were shifted together in the direction of shift R+ until the shifted position V5 was reached. Because this shifted position V5 was at a distance from the starting position V1 which was smaller in size than the distance at which the shifted position V4 reached previously was situated, the work rolls continued to be moved in the direction of shift R+, after the hot rolling of steel strip S5 had taken place in the shifted position V5, until the shifted position V6 was reached.

The distance between this latter and the starting position V1 was larger in size than the distance between shifted position V4 and the starting position and a fresh change in the direction of shift was therefore made on completion of the hot rolling of steel strip S6, which took place at shifted position V6.

The procedure elucidated above was continued for steel strips S7-S26 (shifted positions V7-V26). A point which should be noted in this case is that shifted positions V15, V19, V21, V23 and V25 of the work rolls at which the steel strips S15, S19, S21, S23 were hot rolled were the same as the starting position V1.

When the adjusted position V26 was reached, the travel of the work rolls in adjustment had reached a maximum value from which the sequence of shift of the work rolls reversed.

Accordingly, on completion of the hot rolling of steel strip S26 which took place at shifted position V26, the work rolls were first shifted in the direction of shift R− until the shifted position V27 was reached. This latter coincided with the starting position V1. Even though it was true that the adjusted position V27 was already smaller in size relative to the starting position than the adjusted position V28, the work rolls continued to be shifted, on completion of the hot rolling of steel strip S27 at this adjusted position V27, in the direction of shift R− to a shifted position V28, because the adjusted position V27 as such did not constitute a maximum value of shift due to its not being at any distance at all from the starting position V1.

The distance between the shifted position V28 and the starting position V1 was the same as the distance between the shifted position V26 indicating the maximum value of shift and the starting position V1. The direction of shift was therefore changed after the hot rolling of steel strip S28 which took place at the shifted position V28. The work rolls were therefore once again shifted in the direction of shift R+ until the shifted position V29 was reached, which once was the same as the starting position V1.

After the hot rolling of steel strip S29 at the shifted position V29, the work rolls therefore continued to be shifted in the direction of shift R+ until the shifted position V30 was reached. This latter corresponded to the shifted position V22 and was therefore at a distance from the starting position V1 which was smaller in size than distance at which the shifted position V28 was situated. It was therefore considered a maximum shifted position at which a further reversal of the direction of shift took place.

The above procedure was continued until the shifted position V53 was reached, which position coincided with the starting position V1 and, at it, there no longer appeared to be any purpose in any further shortening of the travel in shift in view of the state of wear of the work rolls. The shifted position V53 itself constituted a minimum value at which it had to be decided whether the same cycle of shifts as has been described had to be repeated, possibly with different, and in particular shorter, travels in shift but in principle with the same sequence of changes of direction, or whether at least one of the work rolls A1/1, A1/2 or A2/1, A2/2 had to be replaced due to its state of wear, which would have been reflected in unacceptably large differences in the shape of the rolled metal strip S.

In the case of the shift strategy which has been described above, the adjusted positions V1-V26 which are reached between the starting position V1 and the shifted position V26 which represents the maximum value of the shift are arranged, about the shifted position V27, with mirror-image symmetry to the shifted positions which are set between the shifted positions V28 to V54, i.e. in the case of the shift strategy which has been explained here, the increase in the size of each of the maximum shifted positions V2, V4, V6, V8, V10, V12, V14, V16, V18, V20, V22, V24, V26, which increase starts from the starting position V1, takes place in the same way as the reduction in the size of the maximum shifted positions V28, V30, V32, V34, V36, V38, V40, V42, V44, V48, V50, V52, which reduction starts from the adjusted position V28 and continues until the last shifted position V53 is reached which indicates the minimum value of the shift.

The cycle described above can be repeated until such time as there is a difference in the shape of the metal strip, particularly in the edge regions of the strip, which is outside the permitted tolerances or is undesirable. The travel in shift then has to be shortened in the appropriate way or the cyclic shift has to be stopped completely.

The shift strategy which has been described here has proved particularly successful with roll stands which are part of a strip casting or thin slab system. Different strategies, and in particular ones in which the increase and decrease in the respective shifted positions which initiate a change in the direction of the shift are not symmetrically arranged in the way described, may be necessary particularly if metal strip of different widths is being rolled in the roll stand. Ideally, the complete rolling schedule covered by a rolling campaign is then taken into account in this connection, in the way described in EP 0 953 384 A2.

Figure 6:
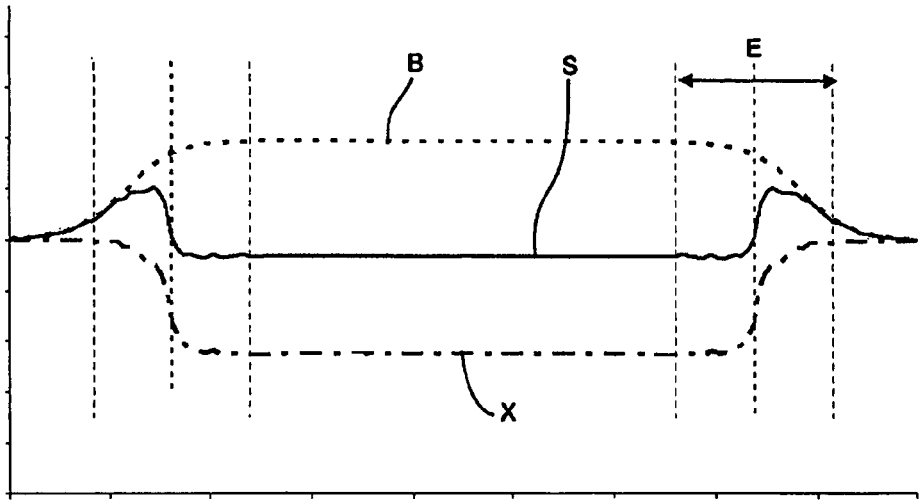
FIG. 6 shows the resulting differences in shape in the case of a shift strategy according to the invention when steel strip is being hot rolled.

The wear X on the work rolls has an effect on the results of the rolling and so too does their crowning B which occurs as a result of heating-up and FIG. 6 shows how these effects are compensated for by the shift strategy according to the invention. It should be pointed out in this case that, with the procedure according to the invention, not only is optimized flatness achieved for the steel strip S obtained in the given case but the formation of tight edges K is also avoided. The range of shift E of the work rolls which is traversed by means of the adjustment cycle which has been explained by reference to FIG. 5 is also shown in FIG. 6.

Figure 7:
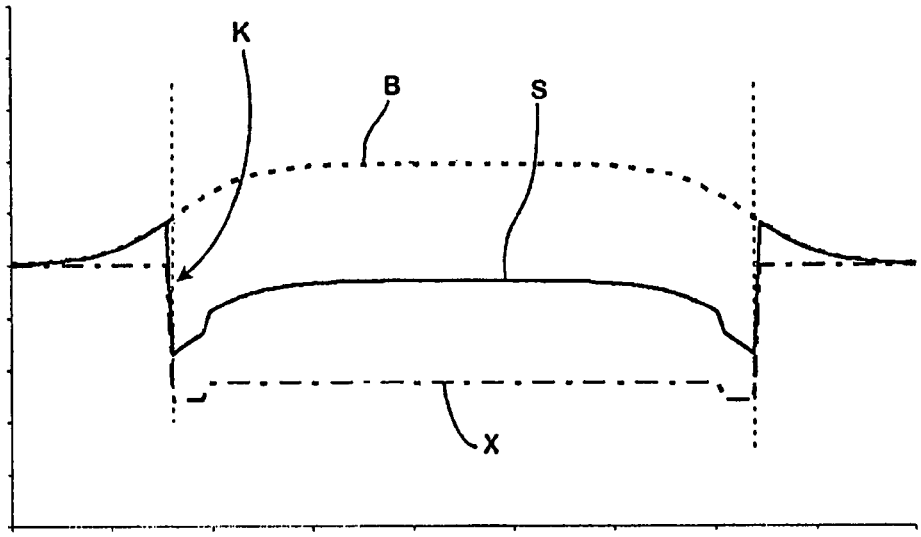
FIG. 7 shows the resulting differences in shape when the steel strip is being hot rolled when there is no compensation for wear and thermal crowning.

As a comparison, what is shown in FIG. 7 is the strip profile which comes into being with increasing wear X on the work rolls and increasing crowning B of them if no adjustment is made to the work rolls.

The invention claimed is:

1. Method of rolling a metal strip, in which the metal strip passes through the a roll gap of at least one roll stand, the work rolls of the roll stand which define the roll gap being able to be shifted along their axes of rotation if differences occur in the shape of the roll gap from a desired shape, the method comprising a) shifting each of the work rolls in the same direction wherein a center of the work rolls moves relatives to a center axis of the metal strip, b) starting from a starting position (V1), maintaining a given direction of shift (R+, R−) until a respective maximum shifted position (V2, V4, V6 . . . , V26) is reached at which a first change takes place in the direction of shift (R−, R+), c) maintaining the direction of shift (R+, R−) which has commenced in a given case until a maximum shifted position (V2, V4, V6 . . . , V26) is reached which, relative to the starting position (V1), is larger in size than, or equal in size to, the maximum shifted position (V2, V4, V6 . . . , V26) which was reached previously in the opposite direction of shift (R−, R+), d) on the given maximum shifted position (V2, V4, V6 . . . , V26) being reached, reversing the direction of shift (R+, R−), e) repeating steps c) and d) until the size of the given maximum shifted position (V2, V4, V6 . . . , V26) has reached a maximum value (V26), f) starting from the maximum shifted position corresponding to the maximum value (V26), maintaining the given direction of shift (R−, R+) until a respective maximum shifted position (V28, V30, V32 . . . , V52) is reached which, relative to the starting position (V1), is smaller in size than, or equal in size to, the maximum shifted position (V28, V30, V32 . . . , V52) which was reached previously in the opposite direction of shift (R−, R+), g) on the given maximum shifted position (V28, V30, V32 . . . , V52) being reached, reversing the direction of shift (R+, R−), h) repeating steps f) and g) until the given maximum shifted position (V28, V30, V32 . . . , V52) of the work rolls (A1/1, A1/2; A2/1, A2/2) corresponds to a minimum value (V53), i) repeating a sequence of steps b) to h) if a worn state of the work rolls is within a permitted range, or the work rolls are replaced if at least one of them has reached a state which is outside the permitted range.

2. Method according to claim 1, wherein at least six changes of the direction of shift (R+, R−) are made between the starting position (V1) and the point at which the shifted position reaches its maximum value (V28).

3. Method according to claim 1, wherein there is performed, between two rolling operations in which the work rolls are at shifted positions of a maximum size (V2, V4, V6, . . . , V28, V28, V30, V32 . . . , V52), at least one rolling operation in which the work rolls occupy a shifted position (V3, V5, V7, . . . , V25) which is located between the maximum shifted positions (V2, V4, V6, . . . , V28, V28, V30, V32 . . . , V52).

4. Method according to claim 1, wherein, to allow a given roll-gap contour to be set, the work rolls are shifted in opposite directions along their axes of rotation.

5. Method according to claim 1, wherein, to allow a given roll-gap contour to be set, one of the work rolls is shifted along its axis of rotation while another work roll remains stationary.

6. Method according to claim 1, wherein at least one metal strip is rolled for its entire length when the work rolls are located in one shifted position (V1-V53) and in that a shift of the work rolls is performed on completion of the rolling of the at least one metal strip.

7. Method according to claim 1, wherein, during the rolling, the work rolls are loaded in bending to correct for deformation of the work rolls which occurs as a result of the rolling forces.

8. Method according to claim 1, wherein the work rolls are pivoted to allow a given roll-gap contour to be set.

* * * * *

UNITED STATES PATENT AND TRADEMARK OFFICE

CERTIFICATE OF CORRECTION

PATENT NO. : 8,627,702 B2
APPLICATION NO. : 12/447619
DATED : January 14, 2014
INVENTOR(S) : André d'Hone It is certified that error appears in the above-identified patent and that said Letters Patent is hereby corrected as shown below:

Title Page, Item (73) Assignee, Line 1, delete "Outokumu Nirosta GmbH," and insert -- Outokumpu Nirosta GmbH, --

Title Page, Item (57) Abstract, Line 13, delete "(V2, V4, V6, ... , V28, V28, V30, V32 ... , V53)." and insert -- (V2, V4, V6, ... , V26, V28, V30, V32 ... , V52). --

In the Claims:

Column 10, Line 38, Claim 1, delete "the a" and insert -- a --

Column 10, Line 38, Claim 1, delete "the work" and insert -- work --

Column 10, Line 44, Claim 1, delete "relatives" and insert -- relative --

Signed and Sealed this
Tenth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,627,702 B2
APPLICATION NO. : 12/447619
DATED : January 14, 2014
INVENTOR(S) : André d'Hone It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 979 days.

Signed and Sealed this
Twenty-second Day of September, 2015

Michelle K. Lee

Michelle K. Lee
*Director of the United States Patent and Trademark Office*